US010112804B2

(12) United States Patent
Jussila et al.

(10) Patent No.: US 10,112,804 B2
(45) Date of Patent: Oct. 30, 2018

(54) ESCALATOR SYSTEM

(71) Applicant: KONE Corporation, Helsinki (FI)

(72) Inventors: Ari Jussila, Helsinki (FI); Toni Hirvonen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/793,082

(22) Filed: Oct. 25, 2017

(65) Prior Publication Data

US 2018/0134523 A1 May 17, 2018

(30) Foreign Application Priority Data

Nov. 15, 2016 (FI) ..... 20165854

(51) Int. Cl.

| | |
|---|---|
| ***B66B 25/00*** | (2006.01) |
| ***B66B 29/00*** | (2006.01) |
| ***B66B 29/02*** | (2006.01) |
| *B66B 21/02* | (2006.01) |

(52) U.S. Cl.

CPC ..... *B66B 25/006* (2013.01); *B66B 25/00* (2013.01); *B66B 29/00* (2013.01); *B66B 29/02* (2013.01); *B66B 21/02* (2013.01)

(58) Field of Classification Search

CPC ..... B66B 25/006; B66B 29/02; B66B 21/02; B66B 29/00; B66B 25/00; B66B 25/003; B66B 29/005; B66B 29/06

See application file for complete search history.

(56) References Cited

U.S. PATENT DOCUMENTS

| | | | | |
|---|---|---|---|---|
| 5,785,165 | A * | 7/1998 | Stahlhut | B66B 25/00 198/322 |
| 6,241,070 | B1 * | 6/2001 | Loder | B66B 29/06 198/323 |
| 6,644,457 | B2 * | 11/2003 | Lauch | B66B 29/06 198/322 |
| 9,469,508 | B2 * | 10/2016 | Lee | B66B 29/06 |
| 2007/0220329 | A1 * | 9/2007 | Steindl | B66B 25/00 714/24 |
| 2016/0368741 | A1 * | 12/2016 | Blondiau | B66B 25/00 |
| 2017/0190548 | A1 * | 7/2017 | Nelson | B66B 29/00 |

FOREIGN PATENT DOCUMENTS

| | | |
|---|---|---|
| JP | 55-101867 U | 7/1980 |
| JP | 62-203177 U | 12/1987 |
| JP | 6-219677 A | 8/1994 |
| JP | 2005-1805 A | 1/2005 |

(Continued)

OTHER PUBLICATIONS

Communication of Acceptance issued in Finnish Patent Application No. 20165854, dated Jul. 12, 2017.

(Continued)

*Primary Examiner* — Mark A Deuble

(74) *Attorney, Agent, or Firm* — Birch, Stewart, Kolasch & Birch, LLP

(57) ABSTRACT

In order to improve safety, an escalator system is configured to drive an escalator in response to a signal received from a user interface located in a first end of the escalator, and to stop movement of the escalator in response to detection of opening of an access cover plate in a second end of the escalator.

12 Claims, 2 Drawing Sheets

(56) References Cited

FOREIGN PATENT DOCUMENTS

| | | | |
|---|---|---|---|
| JP | 2008-001467 | A | 1/2008 |
| JP | 2012-126542 | A | 7/2012 |
| JP | 2014-108833 | A | 6/2014 |
| SG | 195447 | A1 | 12/2013 |
| WO | WO 2011/023846 | A1 | 3/2011 |

OTHER PUBLICATIONS

Search Report issued in Finnish Patent Application No. 20165854, dated May 3, 2017.
European Search Report dated Apr. 13, 2018 for corresponding European Patent Application No. 17201506.7.

* cited by examiner

ESCALATOR SYSTEM

BACKGROUND OF THE INVENTION

Field of the Invention

This invention relates an escalator system and in particular to a solution for improving the safety of an escalator system.

Description of Prior Art

Previously there is known an escalator system with a first pit in a first end of the escalator and with a second pit in a second end of the escalator. Various technical devices needed for driving the escalator are arranged in the first pit and the second pit. Consequently service technicians need to have access to the first and second pit. This access is provided such that the service technician is able to access the first and second pit by opening the access cover plate covering the first or second pit, depending on to which pit access is needed.

A safety risk is involved in working with the devices arranged in the first and second pit. One safety risk relates to the motor and to the moving parts needed to drive the escalator. In case the service technician comes into contact with the moving parts while the escalator is driven, the risk is that a part of the body of the service technician is jammed between moving parts. In order to prevent such injury, known escalator systems are provided with detectors that prevent driving of the escalator in a normal (or automatic) mode while the first or second access cover plate covering the first and second pits is open.

However, the first and second pit are both provided with a user interface which makes it possible for the service technician to drive the escalator in an inspection mode from the first and second pit. The escalator can be driven in inspection mode also when one or more access cover plates is open. This involves a safety risk, in particular when two service technicians work on the same escalator simultaneously. In praxis escalator systems are occasionally implemented in such a way, that a service technician working in a first end of the escalator cannot see the other end of the escalator and is therefore not aware of what the service technician working in the second end is doing.

If in a known escalator installation a service technician working in a first end of the escalator starts to drive the escalator in the inspection mode at the same time as the service technician in the second end opens the access cover plate and enters the second pit where he comes into contact with moving parts, there is a significant risk of injury.

SUMMARY OF THE INVENTION

An object of the present invention is to provide a solution which improves safety of an escalator system. This object is achieved with an escalator system according to independent claim 1 and with a method according to independent claim 8.

A solution where movement of the escalator is stopped in response to detection of opening of an access cover plate in a second end of the escalator improves the safety of the escalator.

Preferred embodiments of the invention are disclosed in the dependent claims.

BRIEF DESCRIPTION OF DRAWINGS

In the following the present invention will be described in closer detail by way of example and with reference to the attached drawings, in which.

DESCRIPTION OF AT LEAST ONE EMBODIMENT

Figure 1:
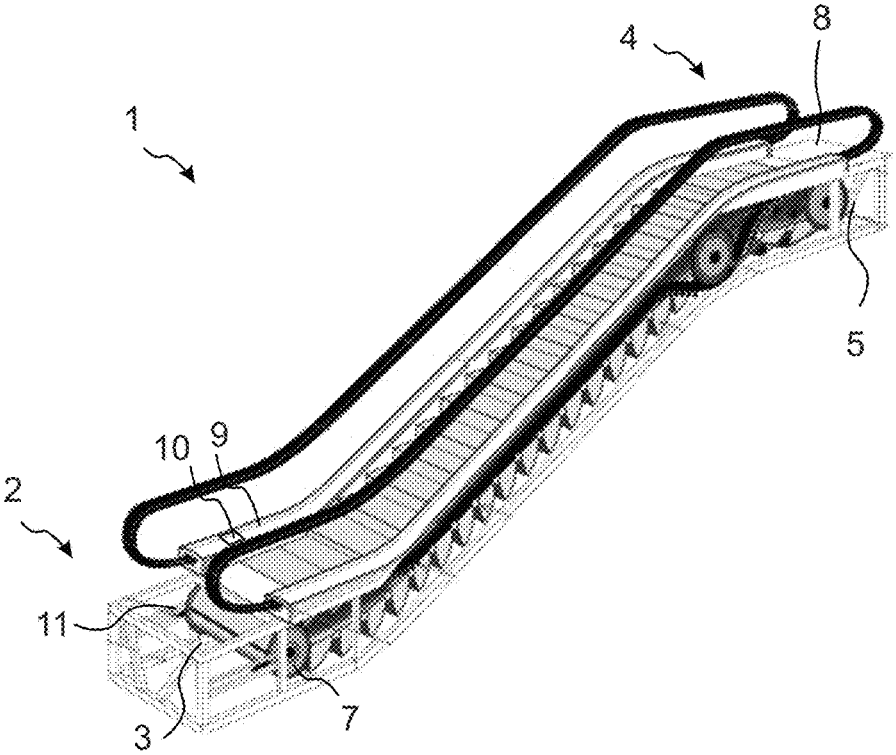
FIG. 1 is illustrates an escalator system.
Figure 2:
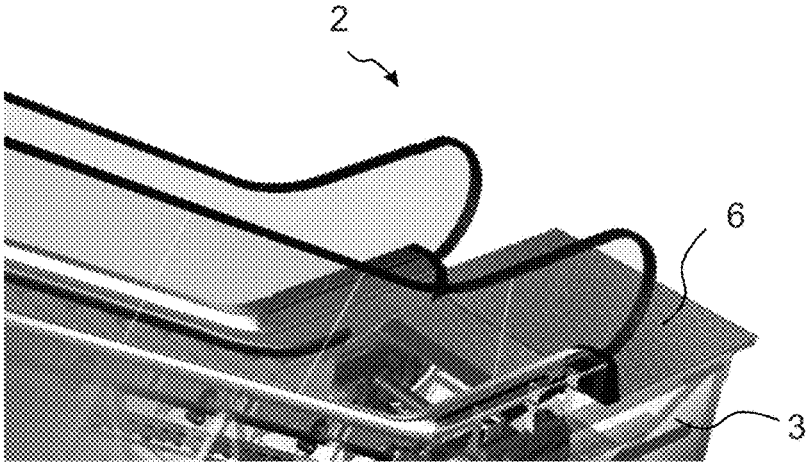
FIG. 2 illustrates the location of a pit in the escalator system of FIG. 1.
Figure 3:
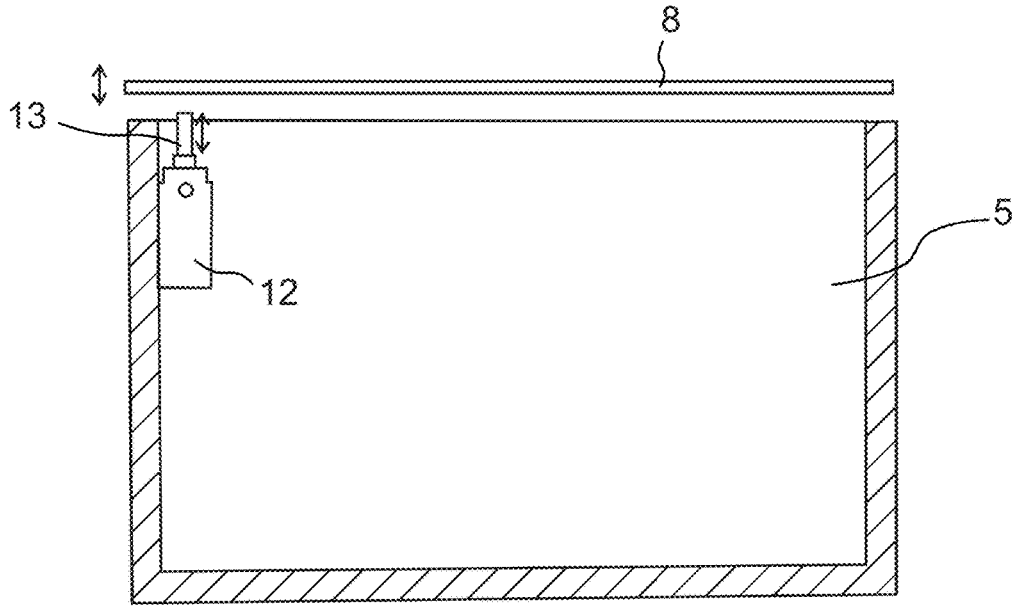
FIG. 3 illustrates a pit of the escalator system of FIG. 1 in cross-section.

FIGS. 1 to 3 illustrate an embodiment of an escalator system 1. A first end 2 of the escalator is provided with a first pit 3 and a second end 4 of the escalator is provided with a second pit 5. As illustrated by way of example in FIG. 1, the first end 2 and the second end 4 of the escalator may be arranged on different floors of a building, for instance. However, in that case the first end is not necessarily the lower end, as illustrated in the figures by way of example, but it is also possible that the first end is the upper end of the escalator. Alternatively the first end and the second end of the escalator may be both arranged on the same floor, in which case the escalator can be used for transporting persons from one location to another while remaining on one single floor.

FIG. 2 illustrates the first end 2 of the escalator with a first access cover plate 6 in a closed position, in other words in a position where the first access cover plate 6 covers the first pit 3 in such a way that persons using the escalator are prevented from falling into the first pit 3. In FIG. 1 the first access cover plate has been removed and is not illustrated at all. Consequently, the first access cover plate 6 is in an open position which allows access to the first pit 3 and to the devices 7 which are located in the first pit 3. The second access cover plate 8 in the second end 4 of the escalator is in FIG. 1 illustrated in a closed position.

A frame 9 of the escalator is provided with a control panel 10. Via this control panel the escalator can be driven in a normal operation mode, also referred to as an automatic mode. Consequently, a person responsible for operating the escalator can during daily use via this control panel stop the escalator and also control it to run in a first direction (such as upwards) and in a second opposite direction (such as downwards). In case the escalator system detects that the first access cover plate 5 or the second access cover plate is in an open position, the escalator system prevents driving of the escalator in the normal mode.

The first pit 3 at the first end of the escalator is provided with a user interface 11. A similar user interface may be provided also in a second pit 5 at the second end 4 of the escalator. This user interface may by implemented with one or more pushbuttons, as a touch screen or as an inspection mode input comprising an electric socket to which a service technician may connect a portable operating panel, for instance. In any case via the user interface 11 the service technician can provide signals to the escalator system to drive the escalator in an inspection mode. The escalator system, which may comprise a control unit controlling an electric motor which in praxis drives the escalator, is configured to allow driving of the escalator in inspection mode also in a situation where first access cover plate 6 is in an open position. One alternative is that the user interface 11 is deactivated until the service technician removes a blind plug. This removal activates both the user interface for driving the escalator in inspection mode and also a stop switch.

FIG. 3 illustrates the second pit 5 in cross section. For simplicity, the devices contained in the second pit are not illustrated in FIG. 3. In the illustrated example the second pit 5 is provided with a detector 12 detecting the position of the second cover plate 8. In FIG. 3 it is by way of example assumed that the detector 12 is implemented as a weight switch with a moving part 13 moving downwards into the body of the weight switch once a part of the weight of the second cover plate 8 comes into contact with the moving part 13. Consequently, the detector is able to detect whether the second cover is in an open position or in closed position. The escalator system is configured to stop movement of the escalator in response to detection of opening of the second cover plate 8. For this purpose the detector 12 may be a simple switch which via braking and closing an electric circuit informs the control unit of the escalator system of the position of the second cover plate 8. Alternatively, the detector 12 may be implemented with circuitry capable of communicating the position of the second cover plate 8 to the control unit via a computer bus, according to the PESSRAE standard, for instance.

One alternative is that the escalator system is configured to, after having stopped driving of the escalator in inspection mode, allow continued driving of the escalator in inspection mode provided that signals received from the user interface 11 indicate that the user has pressed the correct button to continue driving of the escalator. In this way, the first service technician in the first end 2 of the escalator who is driving the escalator in inspection mode via the user interface will notice that a second service technician has opened the second access cover plate 8 due to the fact that the escalator stops. However, immediately after this, in case the first service technician determines it safe and appropriate, the first service technician has the possibility of continuing driving of the escalator. In this way information about the possible safety hazard is efficiently provided to the first service technician, however, in such a way that it does not delay the work of the first service technician more than absolutely necessary.

Figure 4:
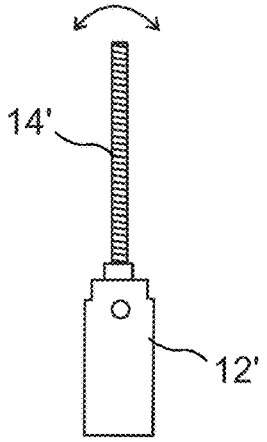
FIG. 4 illustrates a detector which can be used in the escalator system of FIG. 1.

FIG. 4 illustrates a detector 12' which can be used in the escalator system of FIGS. 1 to 3 instead of the detector 12 illustrated in FIG. 3.

The detector 12' of FIG. 4 is provided with a spring 14' which can be bent sideways. When the access cover plate 8 is in closed position, the access cover plate 8 is in contact with this spring 14' such that it is bent sideways, and once the access cover plate is in an open position the spring force returns the spring to the illustrated straight upright position. The spring is provided with electrical contacts indicating the position of the spring such that the escalator system can be provided with information about the position of the access cover plate 8, as previously explained.

In the above explanations and in the figures it has for simplicity been explained that the first pit is provided with the user interface and the second pit is provided with a detector detecting the position of the second access cover plate. However, in practical implementations both the first pit and the second pit are naturally provided with both a user interface and a detector detecting the position of the respective access cover plate. In this way sufficient safety can be ensured, as irrespectively in which end of the escalator a service technician drives the escalator in inspection mode while a second service technician opens the access cover plate in the opposite end of the escalator, the escalator system detects this and stops the escalator.

It is to be understood that the above description and the accompanying figures are only intended to illustrate the present invention. It will be obvious to a person skilled in the art that the invention can be varied and modified without departing from the scope of the invention.

The invention claimed is:

1. An escalator system, wherein the escalator system is configured to:

drive an escalator, via a control unit, in response to a signal received from a user interface located in a first pit in a first end of the escalator; and stop movement of the escalator in response to detection, via a detector, of opening of an access cover plate covering a second pit in a second end of the escalator, wherein the detector communicates the detection to the control unit, wherein the detector is electrically connected to the control unit, wherein the detector is configured to detect whether the access cover plate in the second end of the escalator is open or closed, and wherein the escalator system is configured to, after said stop, in response to signals received from said user interface, activate an inspection mode, to continue driving the escalator irrespective of whether the access cover plate in the second end of the escalator is open or closed during the continued driving.

2. The escalator system of claim 1, wherein the user interface is an inspection mode input.

3. The escalator system according to claim 2, wherein the escalator system is configured to prevent driving of the escalator in a normal mode as long as the access cover plate in the second end of the escalator is detected to be open.

4. The escalator system according to claim 1, wherein the escalator system is configured to prevent driving of the escalator in a normal mode as long as the access cover plate in the second end of the escalator is detected to be open.

5. The escalator system according to claim 1, wherein the detector is a weight switch including a moving part, and wherein the moving part of the weight switch is configured to move downwards into a body of the weight switch once the access cover plate covering the second pit comes into contact with the moving part.

6. The escalator system according to claim 5, wherein the detector communicates the position of the second cover plate to the control unit via a computer bus according to PESSRAE standard.

7. The escalator system according to claim 1, further comprising a blind plug, wherein the user interface is deactivated until the blind plug is removed.

8. The escalator system according to claim 1, wherein the detector includes a spring, wherein the spring of the detector is configured to be bent sideways with respect to a longitudinal axis of the spring when the access cover plate in the second end of the escalator is in the closed position and the spring is configured to have a straight upright position when the access cover plate in the second end of the escalator is in an open position, and wherein the spring includes electrical contacts to indicate the position of the spring.

9. A method for operating an escalator system, comprising the steps of:

driving an escalator via a control unit in response to a signal received at the control unit from a user interface located in a first pit in a first end of an escalator; and detecting opening of an access cover plate covering a second pit in a second end of the escalator via a detector which triggers stopping of movement of the escalator in response to detection of opening of the access cover plate in the second end of the escalator, wherein the detector communicates the detection to the control unit, wherein the detector is electrically connected to the control unit, wherein the detector detects whether the access cover plate in the second end of the escalator is open or closed, and wherein the escalator system activates an inspection mode, after the stopping of movement of the escalator, in response to signals received from said user interface, to continue driving the escalator irrespective of whether the access cover plate in the second end of the escalator is open or closed during the continued driving.

10. The method for operating an escalator system according to claim 9, wherein the escalator system is configured to prevent driving of the escalator in a normal mode as long as the access cover plate in the second end of the escalator is detected to be open.

11. The method for operating an escalator system according to claim 9, wherein the escalator system further includes a blind plug, wherein the user interface is deactivated until the blind plug is removed.

12. The method for operating an escalator system according to claim 9, wherein the detector includes a spring, wherein the spring of the detector is configured to be bent sideways with respect to a longitudinal axis of the spring when the access cover plate in the second end of the escalator is in the closed position and the spring is configured to have a straight upright position when the access cover plate in the second end of the escalator is in an open position, and wherein the spring includes electrical contacts to indicate the position of the spring.

* * * * *